US005920915A

United States Patent [19]

Bainbridge et al.

[11] Patent Number: 5,920,915

[45] Date of Patent: Jul. 13, 1999

[54] PROTECTIVE PADDING FOR SPORTS GEAR

[75] Inventors: David W. Bainbridge, Golden; L. Paul Nickerson, Superior, both of Colo.

[73] Assignee: Brock USA, LLC, Boulder, Colo.

[21] Appl. No.: 09/158,088

[22] Filed: Sep. 22, 1998

[51] Int. Cl.[6] ..... A41D 13/00

[52] U.S. Cl. ..... 2/456; 2/455; 2/463; 2/16; 2/24; 2/267; 5/655.4; 5/911

[58] Field of Search ..... 2/455, 456, 462–465, 2/467, 410, 411, 414, 68, 20, 22, 24, 16, 2.5, 102, 69, 70, 92, 161.1, 909, 910, 911, 227, 267, 268, DIG. 1, DIG. 3; 5/655.4, 702, 911, 953

[56] References Cited

U.S. PATENT DOCUMENTS

| | | | |
|---|---|---|---|
| 1,652,776 | 12/1927 | Galanis . | |
| 2,179,631 | 11/1939 | Holder . | |
| 2,298,218 | 10/1942 | Madison | 5/337 |
| 3,304,219 | 2/1967 | Nickerson . | |
| 3,459,179 | 8/1969 | Olesen . | |
| 3,477,562 | 11/1969 | Allen et al. . | |
| 3,503,841 | 3/1970 | Sterrett . | |
| 3,529,306 | 9/1970 | Thorne . | |
| 3,552,044 | 1/1971 | Wiele . | |
| 3,563,837 | 2/1971 | Smith et al. . | |
| 3,606,726 | 9/1971 | Spertus et al. . | |
| 3,608,961 | 9/1971 | Heck | 5/911 |
| 3,629,882 | 12/1971 | Thorne . | |
| 3,663,344 | 5/1972 | Brock et al. . | |
| 3,755,063 | 8/1973 | Massey et al. . | |
| 3,762,404 | 10/1973 | Sakita | 5/911 |
| 3,816,234 | 6/1974 | Winfield . | |
| 3,889,444 | 6/1975 | Davis et al. . | |
| 3,968,530 | 7/1976 | Dyson | 5/338 |
| 3,968,620 | 7/1976 | Keltner . | |
| 4,011,611 | 3/1977 | Lederman . | |
| 4,054,204 | 10/1977 | Keeton . | |
| 4,102,109 | 7/1978 | Modra et al. . | |
| 4,121,399 | 10/1978 | Verville . | |
| 4,139,920 | 2/1979 | Evans . | |
| 4,171,549 | 10/1979 | Morrell et al. | 5/456 |
| 4,193,499 | 3/1980 | Lookholder . | |
| 4,343,047 | 8/1982 | Lazowski et al. . | |
| 4,370,754 | 2/1983 | Donzis | 2/2 |
| 4,391,561 | 7/1983 | Smith et al. . | |
| 4,432,110 | 2/1984 | Sutton | 5/481 |
| 4,472,472 | 9/1984 | Schultz . | |

(List continued on next page.)

FOREIGN PATENT DOCUMENTS

| | | |
|---|---|---|
| 2495453 | 6/1982 | France . |
| 2616655 | 12/1988 | France . |
| 577 328 | 7/1976 | Switzerland . |
| 1 378 494 | 12/1974 | United Kingdom . |

*Primary Examiner*—Gloria Hale
*Assistant Examiner*—Tejash D. Patel
*Attorney, Agent, or Firm*—W. Scott Carson

[57] ABSTRACT

Protective padding primarily intended for use in sports gear. The pads include flexible, outer casings of porous, breathable, inelastic material overfilled with resilient, discrete beads of elastic material. The beads are initially in compressed states within the casing and place the outer, inelastic casing in tension. When a blow or force is applied, the beads are further compressed to absorb and dissipate the impact. Additionally, the applied blow or force will increase the tension in the outer casing to even further compress the elastic beads for better absorption and dissipation of the impact. In use, the porous pads are compressed and rebound to create a pumping effect that circulates air into and out of the pads drawing heat and perspiration from the athlete's body and keeping the athlete cool and dry. If desired, the pad can be secured directly to the athlete's jersey to enhance this pumping effect as well as the dissipation of the force of any impact. In an alternate embodiment, the outer casing is made of an elastic material that is overfilled to its elastic limit to act in the manner of the preferred embodiments. All of the pads of the present invention are lightweight and washable and can be adapted and integrated into a wide variety of items.

46 Claims, 9 Drawing Sheets

U.S. PATENT DOCUMENTS 4,475,248 10/1984 L'Abbe et al. ..... 2/2.5
4,577,358 3/1986 Glass ..... 5/455
4,606,087 8/1986 Alivizatos ..... 5/424
4,607,403 8/1986 Alivizatos ..... 5/449
4,620,633 11/1986 Lookholder .
4,640,080 2/1987 Wright .
4,642,814 2/1987 Godfrey .
4,657,003 4/1987 Wirtz .
4,905,320 3/1990 Squyers ..... 2/22
5,052,874 10/1991 Johanson .
5,079,787 1/1992 Pollmann .
5,103,517 4/1992 Krouskop .
5,134,725 8/1992 Yeshurun et al. ..... 2/2.5
5,134,726 8/1992 Ross .
5,152,019 10/1992 Hirata ..... 5/448
5,201,780 4/1993 Dinsmoor, III et al. .
5,279,237 1/1994 Alivizatos ..... 5/911
5,351,830 10/1994 Bender et al. .
5,369,829 12/1994 Jay .
5,397,620 3/1995 Hord, III .
5,464,443 11/1995 Wilson et al. .
5,515,975 5/1996 Jarvis et al. .
5,537,688 7/1996 Reynolds et al. ..... 2/20
5,545,128 8/1996 Hayes et al. .
5,584,072 12/1996 Kim et al. .
5,622,030 4/1997 Steed et al. .
5,626,657 5/1997 Pearce .
5,669,079 9/1997 Morgan .
5,675,844 10/1997 Guyton et al. .
5,694,747 12/1997 Tesch .
5,699,561 12/1997 Broersma .
5,711,029 1/1998 Visco et al. .
5,711,215 1/1998 Sextl et al. .
5,712,015 1/1998 Guillem .
5,733,012 3/1998 Jones ..... 297/452.17
5,778,470 7/1998 Haider ..... 5/645
5,826,273 10/1998 Eckes ..... 2/69

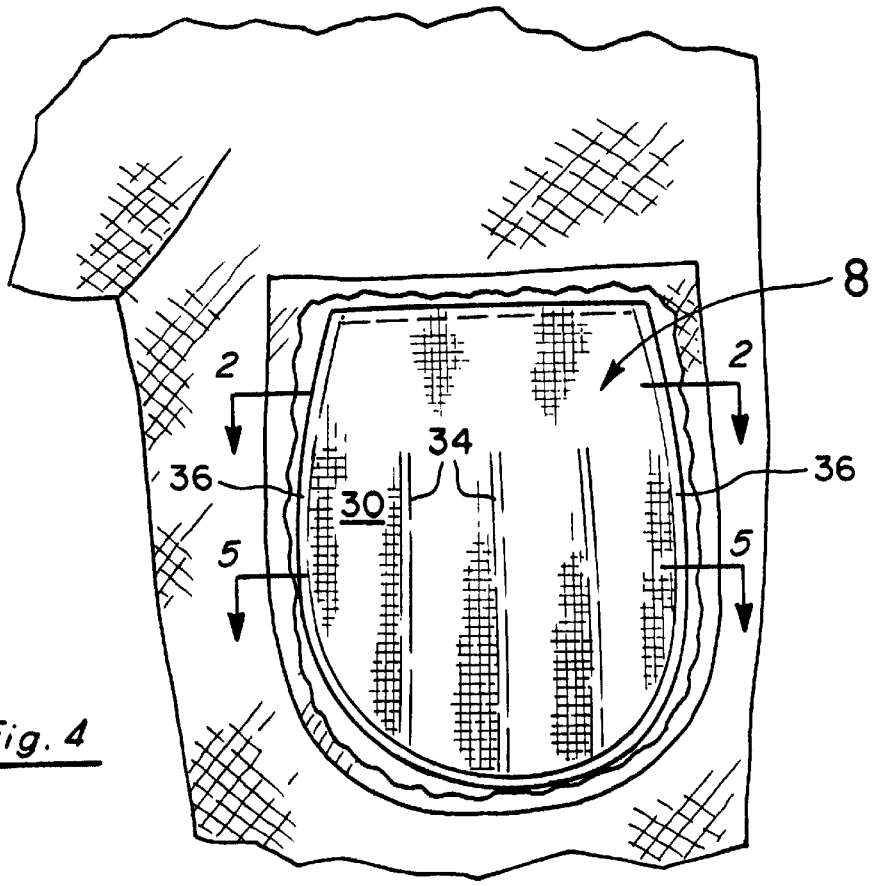
Fig. 4
Fig. 5
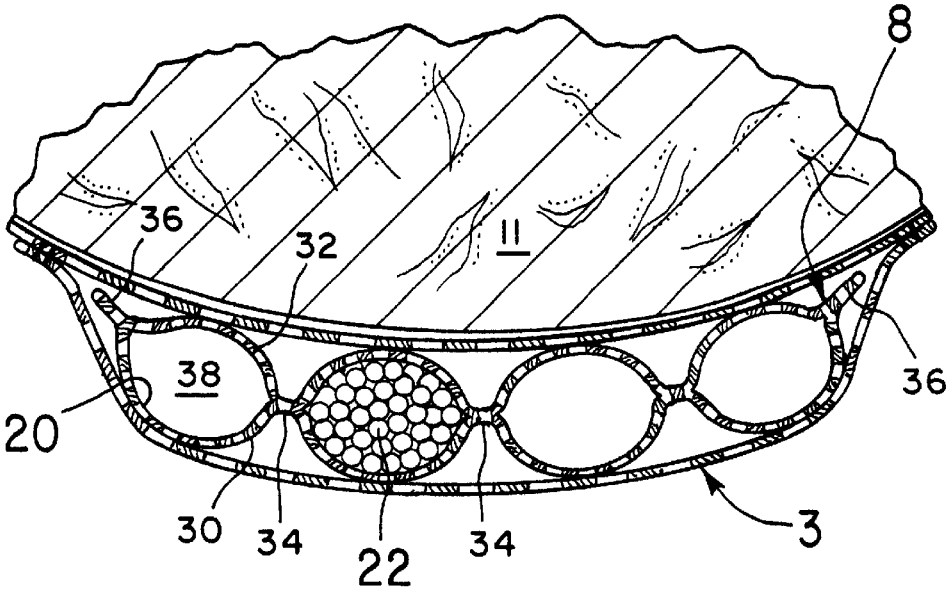

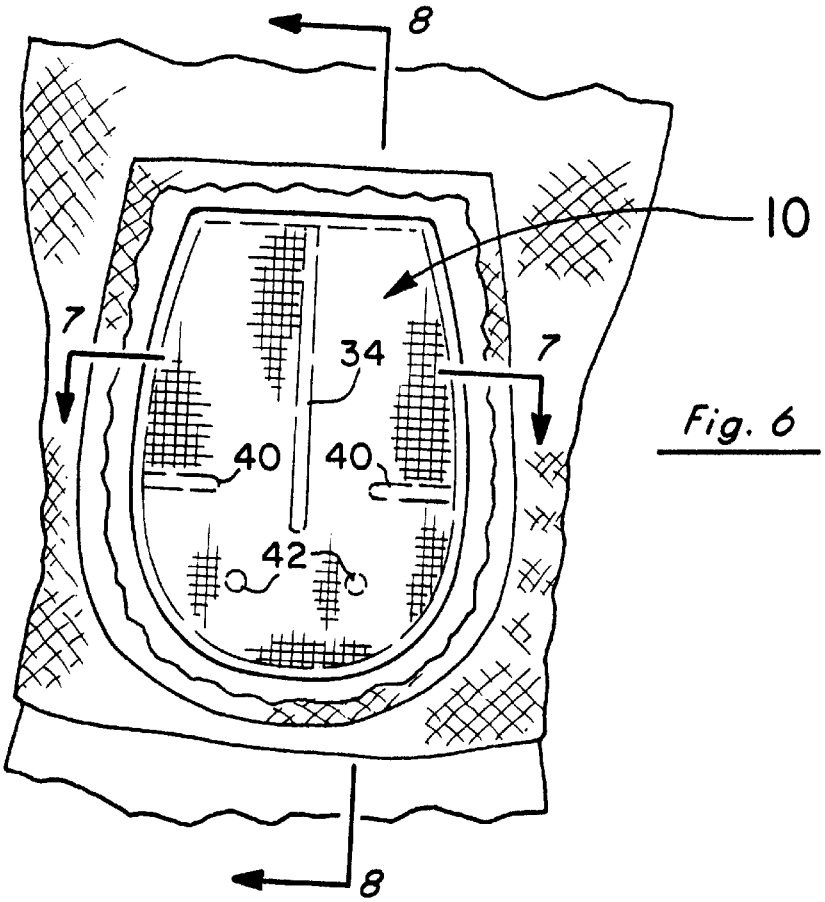
Fig. 6
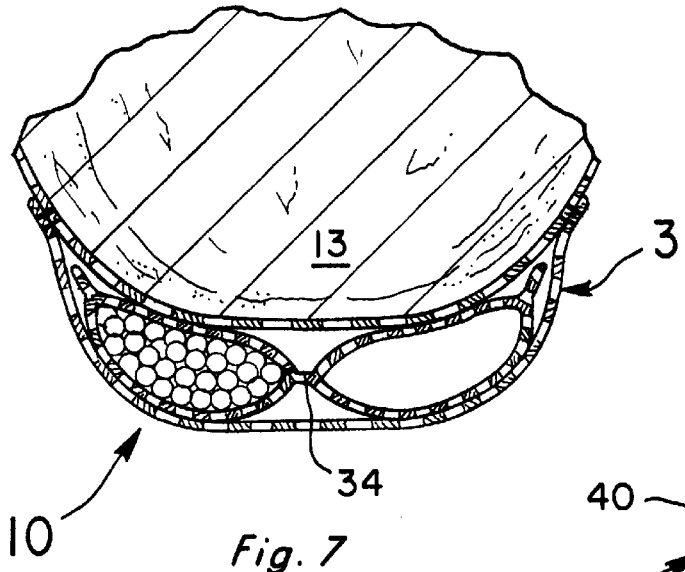
Fig. 7
Fig. 8
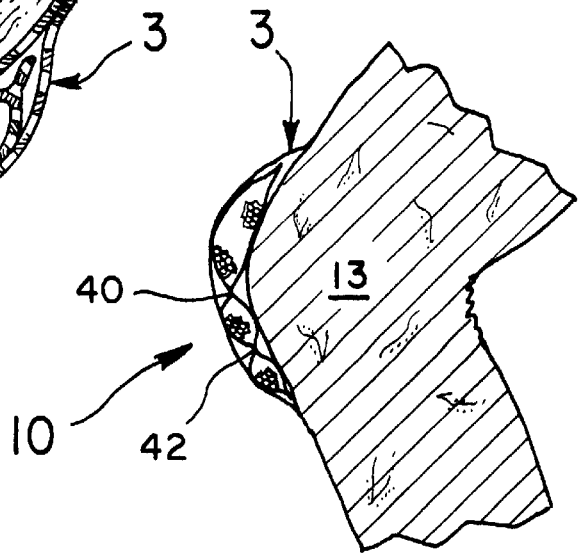

Fig. 10
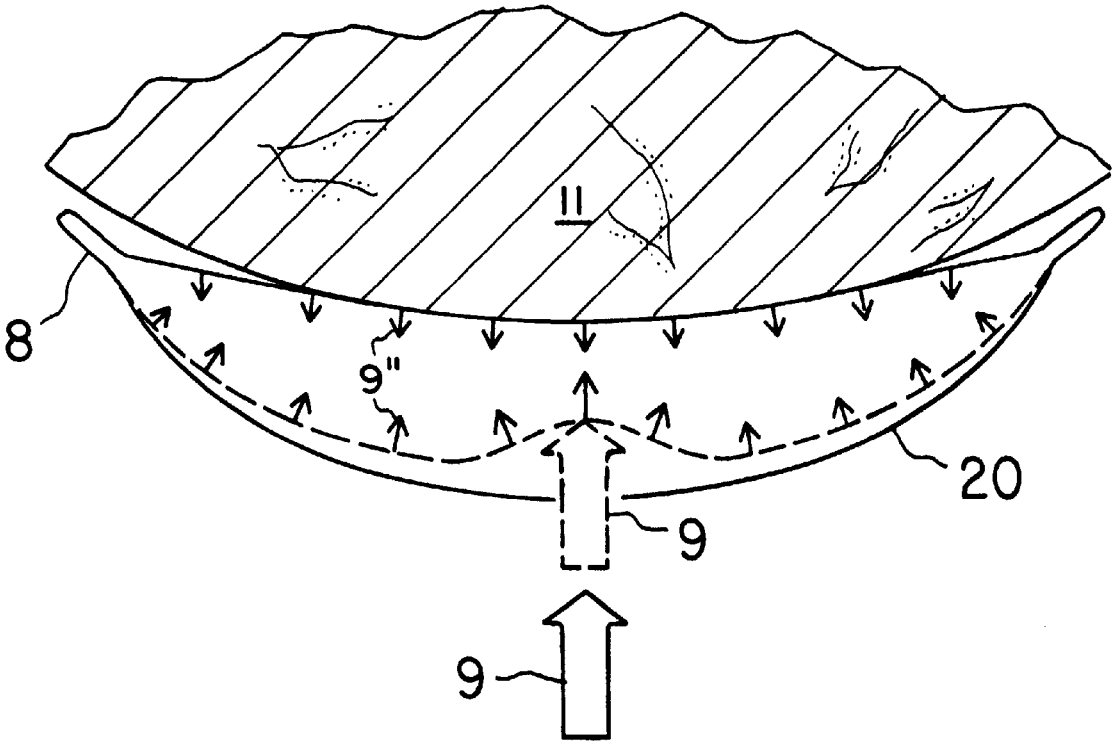
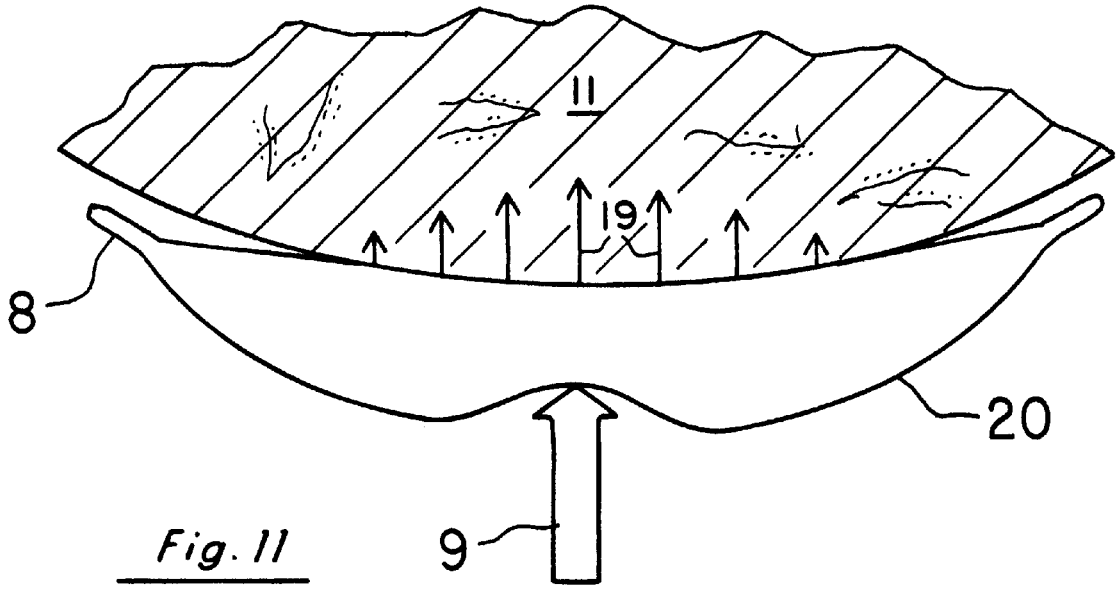
Fig. 11

Fig. 16
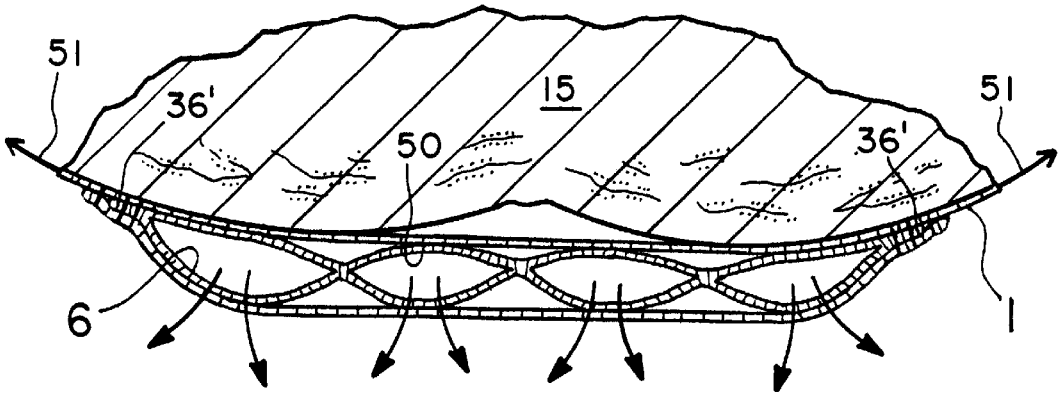
Fig. 17
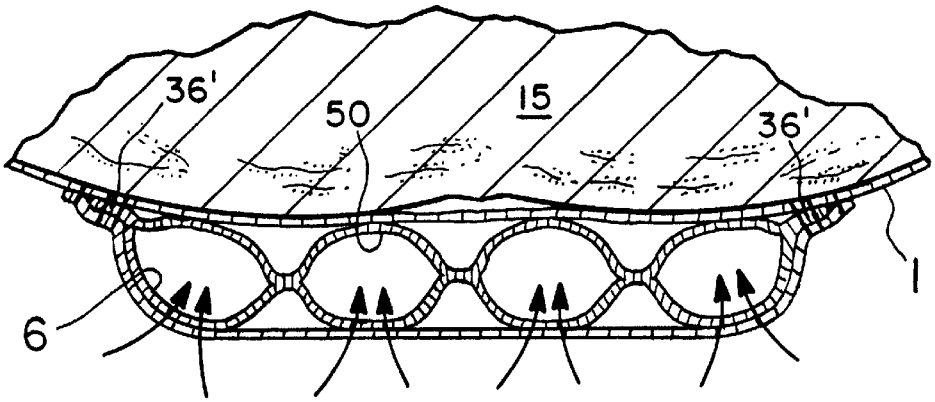
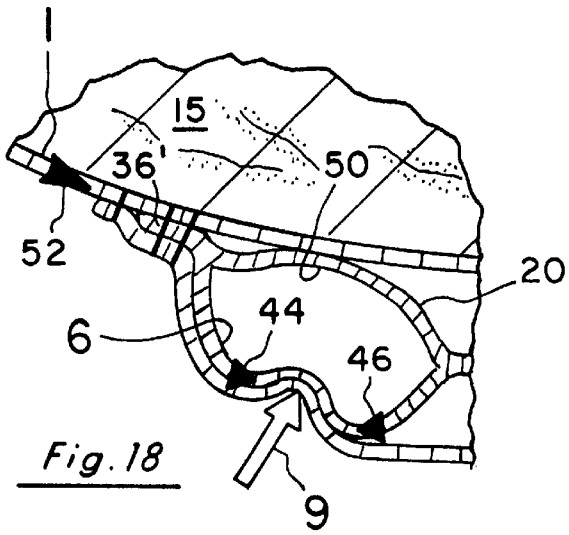
Fig. 18
Fig. 19
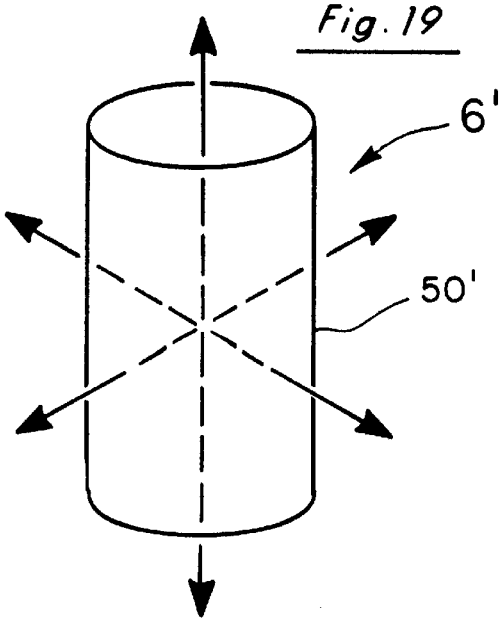

Fig. 20
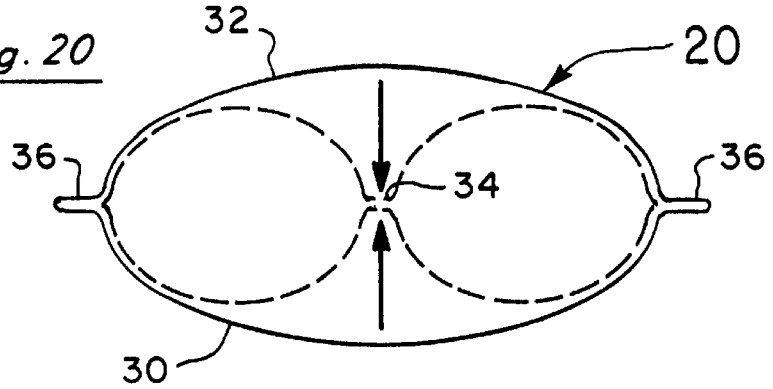
Fig. 21
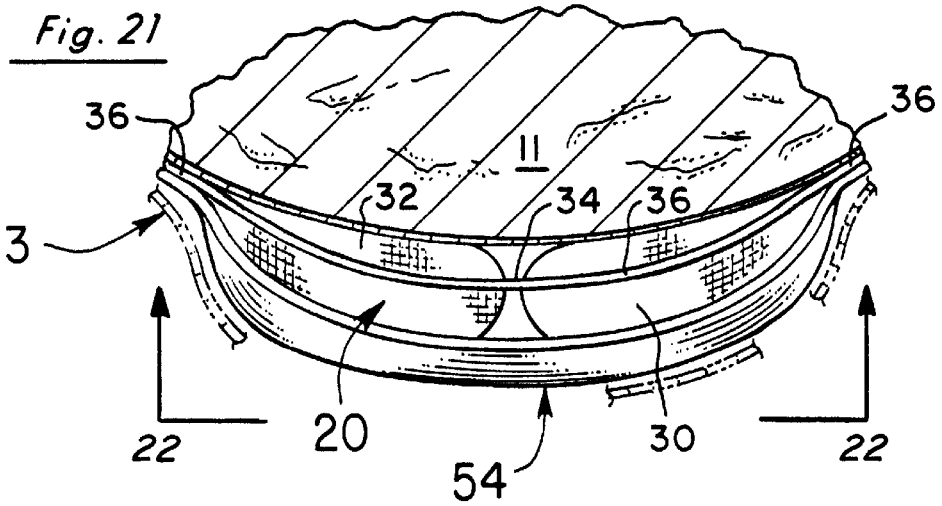
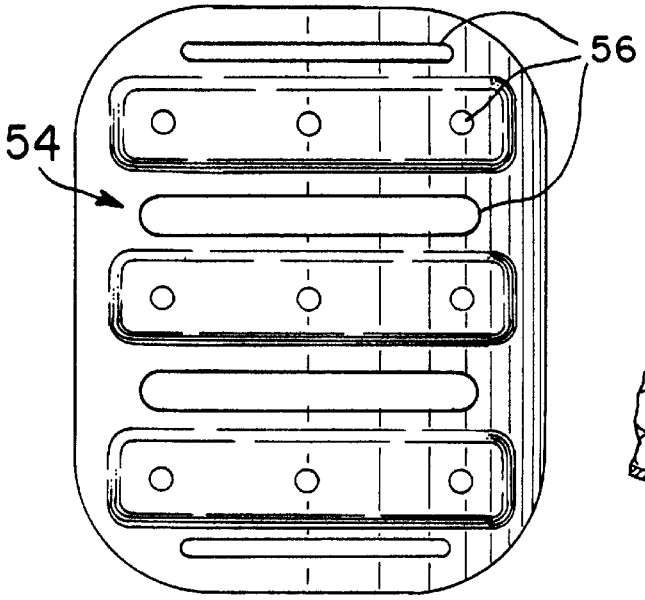
Fig. 22
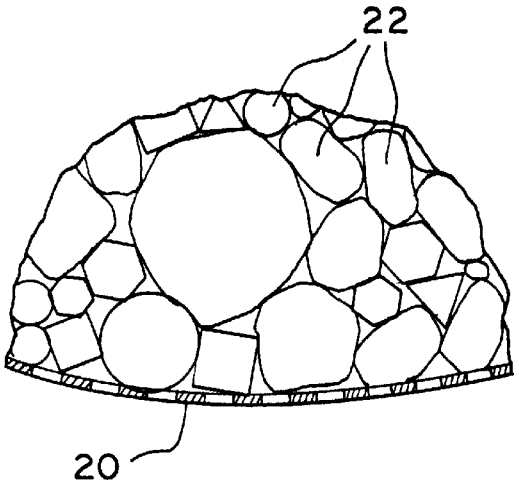
Fig. 23

PROTECTIVE PADDING FOR SPORTS GEAR

BACKGROUND OF THE INVENTION

1. Field of the Invention

This invention relates to the field of padding and more particularly, to the field of protective padding for sports gear.

2. Discussion of the Background

Designing protective padding for sports gear presents numerous challenges. In addition to having the padding perform its primary function of repeatedly absorbing and dissipating high impact forces, such padding would ideally be lightweight, breathable, and washable. Further, it would preferably be easily integrated into sports gear such as jerseys, pants, and helmets as well as be adaptable for specialized uses such as removable knee and elbow pads. All of the above would be accomplished in a manner that would not unduly inhibit the athlete's movements and dexterity on the field.

Many prior art pads and padding techniques accomplish some but not all of these goals. For example, U.S. Pat. No. 4,343,047 to Lazowski uses loosely filled, lightweight beads in a breathable casing to form a helmet pad. The helmet pad easily conforms to the contours of the wearer's head and in use, the loose beads are designed to move or shift around relative to each other within the casing. The beads are also designed to be crushed to absorb and attenuate high impact loads and forces. Such crushable padding is essentially effective for only one application and one impact situation, much like a car airbag in an emergency. As a practical matter, such padding cannot be used for other athletic gear such as football pants with thigh and knee pads that must withstand and be effective under repeated blows and impacts without losing their integrity.

Other prior art pads use incompressible beads that are designed not to be crushed (e.g., British Patent No. 1,378,494 to Bolton, U.S. Pat. No. 3,459,179 to Olesen, and U.S. Pat. No. 4,139,920 to Evans). Still others use compressible beads that are also designed not to be crushed such as U.S. Pat. No. 3,552,044 to Wiele and U.S. Pat. No. 5,079,787 to Pollman. However, in each case, the beads are loosely packed to allow the beads to move or roll relative to each other in an effort to achieve maximum conformation to the shape of the particular body part. Wiele in this regard even lubricates his beads to enhance their flowability. The thrust of these underfilled pads as expressed by Olesen, Wiele, and Pollman is to achieve padding with the flow and conforming characteristics of liquid-filled pads, but without the undesirable weight of such heavy fillings. Liquid-filled pads also necessarily require waterproof casings that make them unduly hot in use as they do not breathe. While such pads of loosely filled beads essentially conform like a liquid, the underfilled beads in them have an undesirable tendency to move out of the way in use. This tendency reduces the thickness of the padding around the body part and can even allow the body part to bottom out in the pad. In such a case, the beads essentially move completely out of the way and the only protection left is simply the two layers of the casing for the pad. This is particularly true when used for impact padding where the blows tend to occur repeatedly at the same location. Such loose-filled pads for the most part are ineffective for such uses.

In the athletic field today, the standard padding used is one or more sheets or layers of foam. Foam in this regard has the distinct advantages of being lightweight and relatively inexpensive. For the most part, there are two types of such foam padding. The first is closed cell which has the advantage of not absorbing moisture or other fluids. However, layers of closed-cell foam tend to be stiff and do not conform well to the body, particularly when the athlete is active. They also do not breathe to dissipate body heat and generally cannot be sewn into or washable with the athlete's uniform. The second type of commonly used foam is opened cell. These foams tend to be softer and more pliable than closed cell foams; however, they absorb moisture and odor and generally need to be coated with a waterproof material (e.g., vinyl). This coating then makes the pads non-breathable and very hot.

With these and other concerns in mind, the padding of the present invention was developed and specifically adapted for use in sports gear. The present padding is lightweight, breathable, and washable. It can also be easily incorporated to protect a variety of body parts, all without unduly inhibiting the athlete's movements and actions. The padding is relatively simple and inexpensive to manufacture and can be easily integrated into nearly all sports gear.

SUMMARY OF THE INVENTION

This invention involves protective padding primarily intended for use in sports gear. In the preferred embodiments, the pads include flexible, outer casings of porous, breathable, inelastic material overfilled with resilient, discrete beads of elastic material. The beads are initially in compressed states within the casing and place the outer, inelastic casing in tension. When a blow or force is applied, the beads are further compressed to absorb and dissipate the impact. Additionally, the applied blow or force will increase the tension in the outer casing to even further compress the elastic beads for better absorption and dissipation of the impact. In use, the porous pads are compressed and rebound to create a pumping effect that circulates air into and out of the pads drawing heat and perspiration from the athlete's body and keeping the athlete cool and dry. If desired, the pads can be secured directly to the athlete's jersey or other article of clothing to enhance this pumping effect as well as the dissipation of the force of any impact. In an alternate embodiment, the outer casing is made of an elastic material that is overfilled to its elastic limit to act in the manner of the preferred embodiments. All of the pads of the present invention are lightweight and washable and can be adapted and integrated into a wide variety of items.

BRIEF DESCRIPTION OF THE DRAWINGS

FIG. 4 is a further illustration of the pad of FIG. 2 showing its segmenting.

FIG. 5 is a cross-sectional view taken along line 5—5 of FIG. 4.

FIG. 6 illustrates the knee pad of FIG. 1 incorporating the padding technology of the present invention.

FIG. 7 is a cross-sectional view taken along line 7—7 of FIG. 6.

FIG. 8 is a cross-sectional view taken along line 8—8 of FIG. 6.

FIG. 10 schematically illustrates the increased compression forces applied by the casing as it is further tensioned by the applied blow.

FIG. 11 schematically shows the dissipation and reduction of the applied blow as received by the athlete's body.

FIGS. 16 and 17 are views similar to FIGS. 14 and 15 with boundary portions of the pad attached to the jersey to further enhance the pumping action.

FIG. 18 illustrates an additional advantage of securing the pad to the jersey wherein the jersey is pulled or drawn in by the pad to further dissipate the force of any impact.

FIG. 19 schematically illustrates the multi-directional movement of air into and out of the pads of the present invention.

FIG. 20 illustrates one method of making the overfilled pads of the present invention.

FIG. 21 shows a pad according to the present invention used in combination with an outer, hard shell.

FIG. 22 is a view taken along line 22—22 of FIG. 21.

FIG. 23 illustrates the use of discrete beads of different shapes and sizes.

DETAILED DESCRIPTION OF THE PREFERRED EMBODIMENTS

Figure 1:
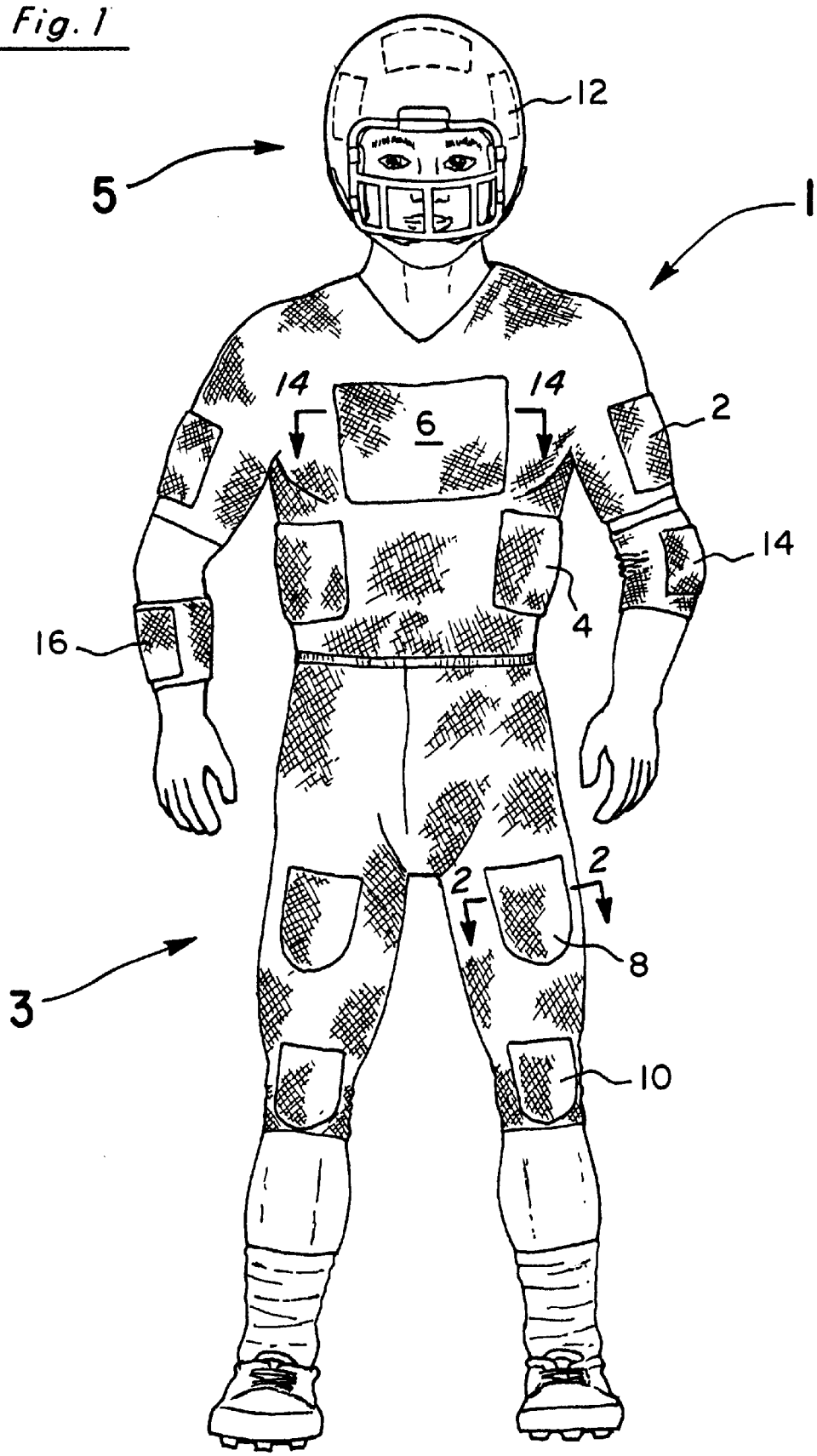
FIG. 1 illustrates the padding technology of the present invention adapted and integrated into sports gear for football.

FIG. 1 illustrates the padding technology of the present invention adapted and integrated into sports gear for football. The particular gear shown in FIG. 1 includes an under or liner jersey 1 with upper arm 2, rib 4, and sternum 6 pads. The illustrated gear also includes liner pants 3 with thigh 8 and knee 10 pads and helmet 5 with head pads 12. Liner gear such as jersey 1 and pants 3 are commonly worn by football players next to their bodies. Full shoulder pads and exterior or playing jerseys and pants are then worn over the liner gear and can also be padded according to the present invention. The current technology additionally can be easily adapted for use in nearly any and all other types of padding including separate and removable ones such as elbow 14 and forearm 16 pads in FIG. 1.

Figure 2:
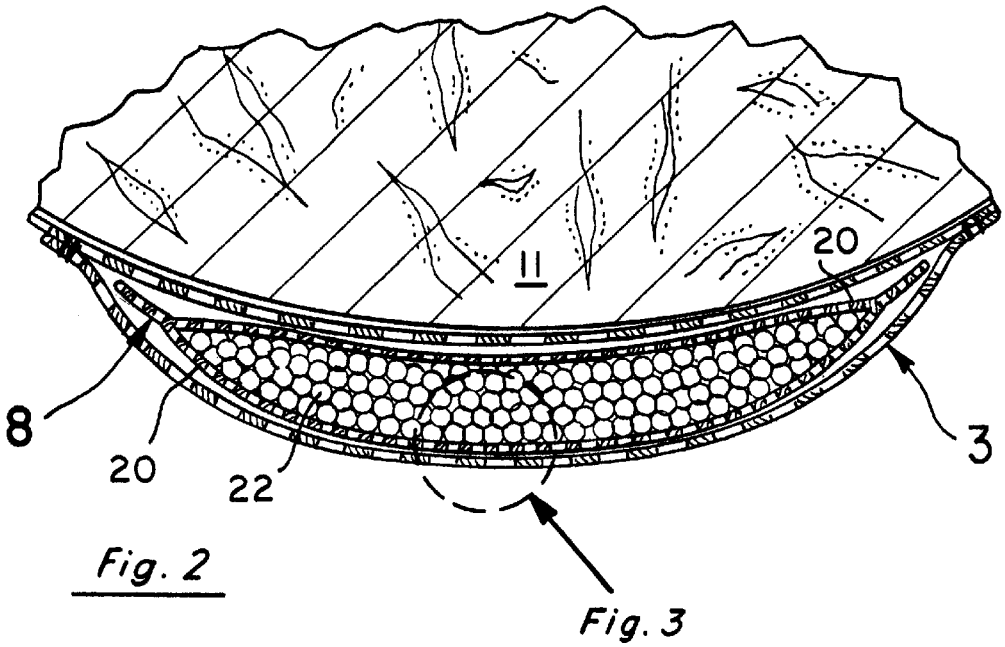
FIG. 2 is a cross-sectional view of the thigh pad of FIG. 1 taken along line 2—2 of FIG. 1.

The basic structure of the protective pad of the present invention as typified by the thigh pad 8 in FIGS. 1 and 2 includes an outer casing 20 (see FIG. 2) which is overfilled with beads 22. In use, the entire pad 8 is then received or sewn into a pocket in the pants 3. The outer casing 20 of the pad 8 is preferably made of a porous, breathable, and flexible material that is substantially inelastic. In the preferred embodiment, the casing 20 is a plastic mesh of a substantially waterproof material as polypropylene which is heat sealable. Other substantially inelastic, porous, and flexible materials could also be used if desired such as woven or unwoven fiberglass, polyester, or nylon yarns preferably coated with PVC to make them heat sealable and waterproof. The casing 20 is overfilled with soft, resilient, discrete beads 22 of elastic material. The beads 22 are also preferably made of lightweight and waterproof material (e.g., a closed-cell foam such as polypropylene). In this manner and although the pad 8 is extremely porous, the casing 20 and beads 22 of the pad 8 do not absorb water, other liquids, or odors and the entire pad 8 can be washed and dried with the pants 3 and the rest of the gear of FIG. 1. The beads 22 can be of a variety of different shapes and sizes but preferably are spherical beads ranging in diameter from about 0.05 to about 0.5 inches. Depending upon the application, the beads could be smaller or larger but would still have the operating characteristics discussed below. The pores of the outer casing 20 are preferably as large as possible without allowing the beads 22 to pass through them during use.

The beads 22 are overfilled in the casing 20 meaning that the fill is higher than a simple gravity fill. Consequently, substantially all of the resilient beads 22 are in compression. The actual overfill above 100% can be up to 160% or more but is preferably about 120%. As illustrated in the enlarged view of FIG. 3, this leaves the compressed, spherical beads 22 of the preferred embodiments slightly distorted or flattened on the abutting portions 24 while the spaced-apart portions create the interstitial spaces 26 therebetween. Each bead 22 is thus compressed to under 100% to about 40% of its relaxed, uncompressed volume. Preferably, the compression is about 80% of the relaxed volume. The total volume of the interstitial spaces 26 under a gravity fill can be on the order of 35% of the casing volume. With the beads 22 initially compressed, this interstitial volume is then less than about 35% down to about 5% of the volume of the casing 20. Preferably, the interstitial volume is about 25%–30% of the casing volume with the compressed beads 22 then occupying the remaining volume of the casing 20.

The opposing portions 30 and 32 of the casing 20 in the thigh pad 8 as shown in FIGS. 4 and 5 are preferably segmented or joined by seams 34. Such segmenting or joining of the opposing portions 30 and 32 within the pad boundary 36 helps to prevent the pad 8 from ballooning. Depending upon the spacing of the segments 34, the cross-sectional shapes of the individually padded areas or pouches of the pad 8 can be varied to create nearly circular ones like 38 in FIG. 5 or more elongated ones such as shown in FIG. 2. (For clarity, the beads 22 are illustrated in FIG. 5 in only one of the pouches 38 but the beads 22 would be in all of the pouches 38.) The segmenting or joining at linear seams 34 also provides predetermined fold lines or patterns to help the pads conform better to the curved shapes of the user's body such as to his or her thigh 11 in FIG. 5. Such conformation gives the thigh pad 8 less of a tendency to rotate or otherwise move out of place. This is particularly important for the pads protecting joints such as the knee pad 10 in FIGS. 6–8. As illustrated the knee pad 10 is provided not only with a vertical segment or seam 34 but also with horizontal seams 40 and spot or dot attachments 42. Vertical segment 34 in FIG. 6 helps the knee pad 10 to conform about the knee 13 (FIG. 7) while the substantially perpendicular or horizontal segments 40 (FIG. 8) aid the pad 10 to bend with the natural flex of the knee joint. Spot or dot attachments 42 help to keep the pad 10 from ballooning.

Figure 3:
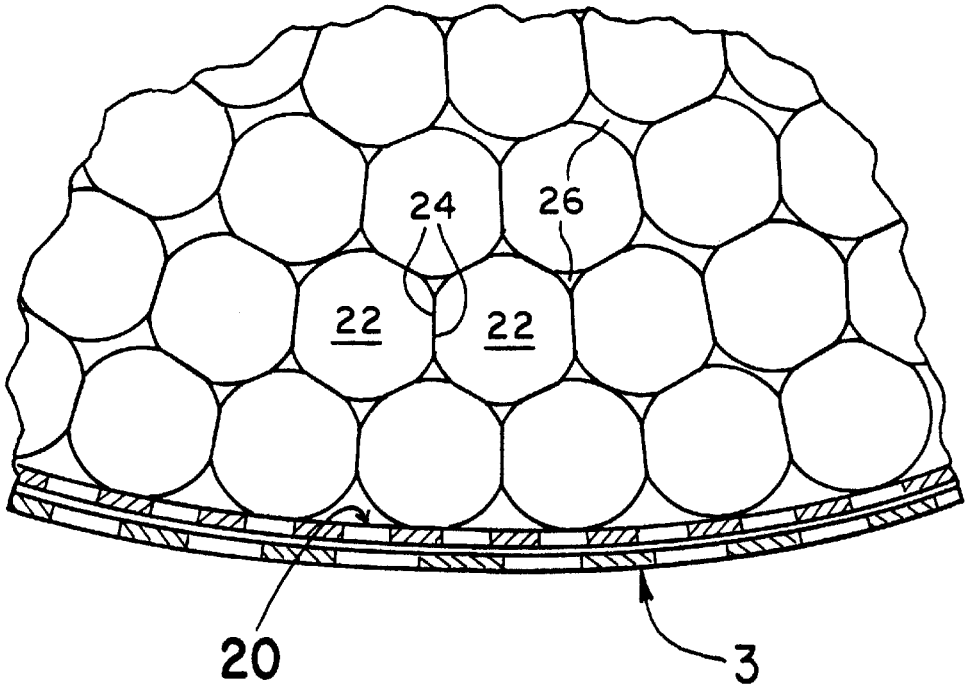
FIG. 3 is an enlarged, cutaway view of the pad of FIG. 2 showing the initially compressed state of the beads in it.

The initially compressed beads 22 of FIGS. 2 and 3 within the casing 20 serve to place the outer, inelastic casing 20 in tension. This has the beneficial result of aiding in the absorption and dissipation of any blow applied to the pad. More specifically and referring to FIG. 9 (in which only the pad 8 and athlete's thigh 11 are shown for clarity), any impact or blow 9 to the casing 20 will depress the inelastic casing 20 at the point of the blow 9. This depression in turn will draw in the casing 20 immediately to the sides 44 and 46 of the blow 9. The force applied by the blow 9 in FIG.

9 will then be absorbed and dissipated by the beads 22' directly under the blow 9 and by the surrounding beads 22", which will be further compressed by the increased tension in the casing 20 as explained below.

Figure 9:
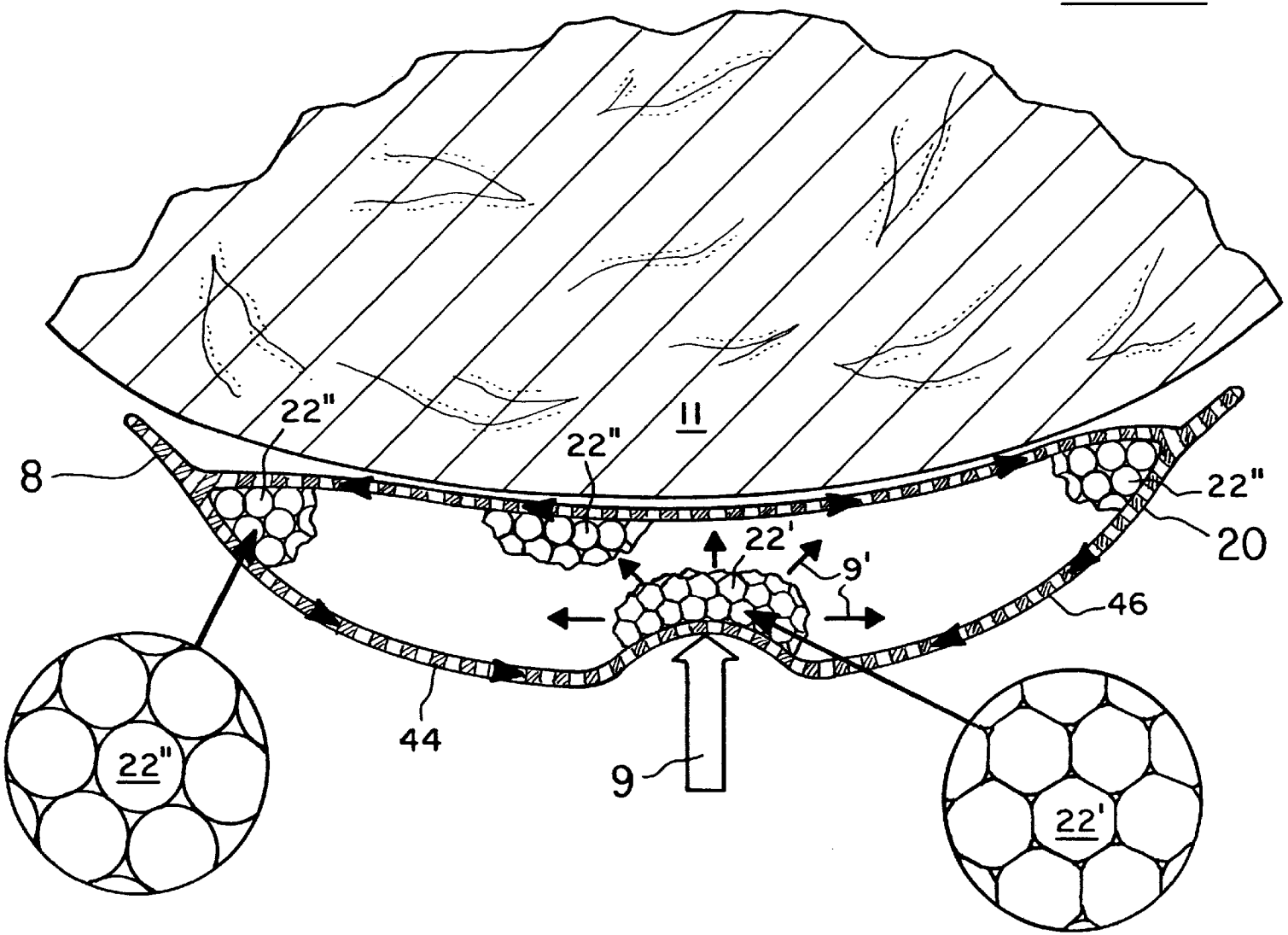
FIG. 9 is an enlarged view of the pad of FIG. 2 initially receiving a blow or impact.

More specifically, the beads 22' directly under the blow 9 in FIG. 9 will first and foremost be further compressed by the blow 9 from their initially compressed state as in FIG. 3 to that of FIG. 9. These further compressed beads 22' at the point of blow 9 in FIG. 9 will then send or radiate compressive forces 9' outwardly to the remaining beads 22". These remaining or surrounding beads 22" in turn will be further compressed from their initial states by the radiating forces 9' acting on the beads 22" against the retaining force of the inelastic casing 20. This radiating action is essentially an inside-out one. Additionally, and because the casing 20 is inelastic and does not stretch, the blow 9 will draw in the casing 20 immediately to the sides 44 and 46 of the blow 9. This movement of sides 44 and 46 will reduce the casing volume and further tension the casing 20. It will also cause the casing 20 to increase the compression of the beads 22", essentially by applying forces 9" as illustrated in FIG. 10 from the outside-in. In these manners, the initial force of the blow 9 will be absorbed and dissipated within the pad 8 and the forces actually transferred to the athlete will be greatly reduced as schematically illustrated by forces 19 in FIG. 11. Preliminary tests show this reduction to be quite significant over the currently most popular pads and padding. Further, because of the resiliency of the discrete beads 22' and 22" in FIG. 9, the propagation of the force through the pad 8 is slower than through a pad, for example, composed of simply a layer of foam. This slower propagation speed helps to further dissipate the impact.

In use, the pads of the present invention offer still other unique advantages. Because the pads are overfilled and the casings initially tensioned, the pads are biased toward a first shape and volume. That is, when unimpeded by any external forces, each pad will assume a first, predetermined shape such as the symmetrical one illustrated in FIG. 12. Depending upon the amount of overfill of the beads 22 and other factors such as the relative stiffness of the casing 20 and the relative spacing of any segments 34, the unrestrained, single pouch 50 of the pad in FIG. 12 tends toward a nearly circular cross section. Even under mild restraints such as the pants 3 on the motionless athlete of FIGS. 1 and 5, the multiple pouches 38 of the thigh pad 8 in FIG. 5 are still individually biased toward a first or free shape such as in FIG. 12. Such bias for the most part is provided by the outwardly directed forces of the compressed beads 22 acting against each other and against the flexible but inelastic, outer casing 20.

In a like manner, even the more flattened or elongated pouch of pad 8 in FIGS. 2 and 10 is biased toward a first shape and volume. Consequently, if a blow such as 9 in FIG. 10 is delivered compressing the pad 8 (as shown in dotted lines in schematic FIG. 10), the pad 8 upon dissipation of the blow 9 will automatically rebound to the original shape and volume shown in solid lines in FIG. 10. (For clarity, only the athlete's thigh 11 and the elongated pouch of pad 8 are shown in this schematic FIG. 10.) Because the casing 20 is porous and breathable and because the compressible beads 22 form interstitial spaces 26, this action on the pad 8 will have a desirable pumping effect. Such effect will force or pump air out of the pad 8 during the compression of blow 9 and draw in ambient air during the return or rebound toward the original shape.

Figure 13:
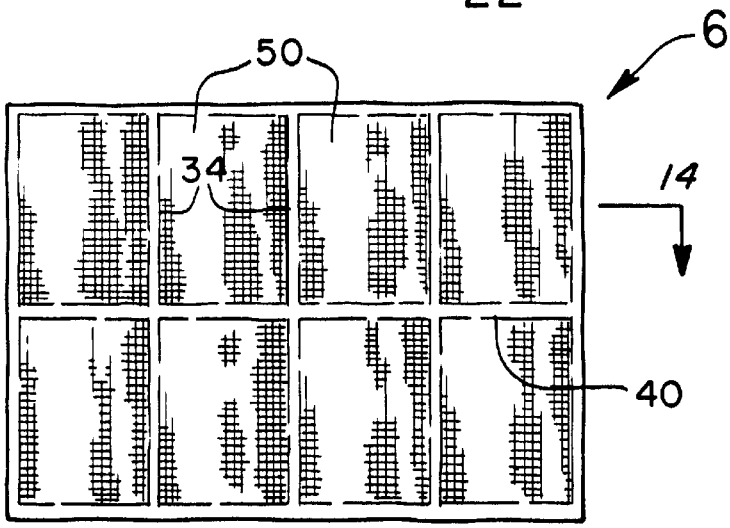
FIG. 13 shows the sternum pad of FIG. 1 incorporating the padding technology of the present invention.
Figure 14:
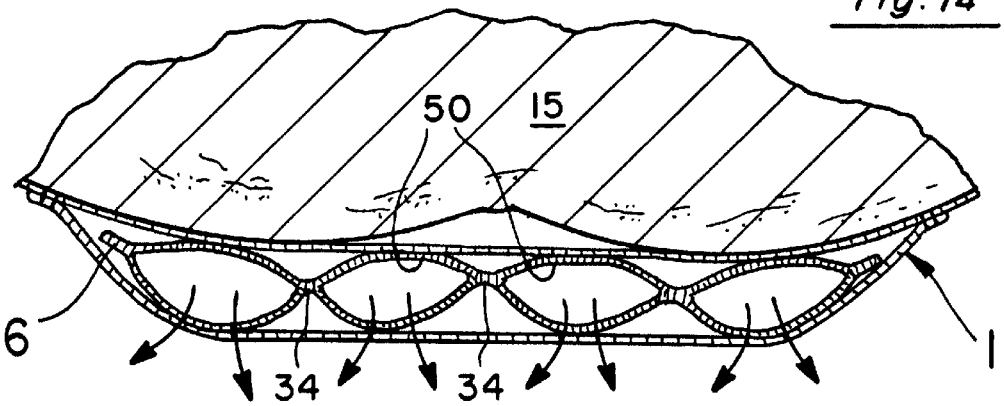
FIG. 14 is cross-sectional view taken along line 14—14 of FIGS. 1 and 13 showing the pouches of the pad substantially compressed to pump air out of them.
Figure 15:
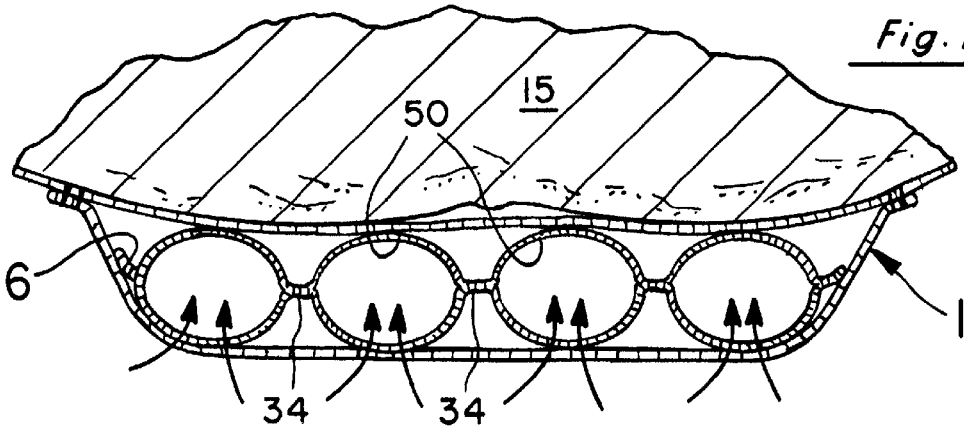
FIG. 15 is a view similar to FIG. 14 showing the pouches of the pad rebounding to their initial shape and volume to draw ambient air into them.

This pumping effect also occurs with any natural movement of the athlete that tends to further compress and then release the pad (e.g., flexing and unflexing the knee in FIG. 8 during running). Such movement, as with a blow, first compresses the beads 22 further and reduces the total volumes of the casing 20 and the interstitial spaces 26. The resilient beads 22 then rebound to their initial state and volume returning the casing 20 and interstitial spaces 26 to their original volumes. This action is a pumping one and has its most beneficial effect around the jersey 1 to help dissipate and draw or wick away the athlete's body heat and perspiration. More specifically and referring to the chest or sternum pad 6 of FIGS. 1 and 13, the pad 6 would typically have a plurality of individual, completely compartmentalized pouches 50 (see FIG. 13). These individual pouches 50 would be separated by vertical and horizontal seams 34 and 40. In use as illustrated schematically in FIG. 14 and 15 (in which the pouch beads are not shown for clarity), the pouches 50 of the pad 6 alternately expel and draw in air. That is, at maximum inhalation or movement, the lateral or side-by-side array of pouches 50 in the jersey pocket 1 in FIG. 14 would assume compressed positions or shapes pumping air along with body heat and perspiration out of the pouches 50 and through the porous, mesh jersey 1. During simple breathing, this compression is caused primarily by the already tightly fitting jersey 1 being drawn even tighter about the athlete's chest 15 during inhalation. Upon exhaling, the pouches 50 naturally return or rebound to the positions of FIG. 15 drawing or pumping in ambient air. With each breath and/or movement, the process is repeated, cooling and drying the athlete's body.

To further enhance the pumping effect of the pads of the present invention, boundary or other spaced-apart portions of the pads can be secured if desired to move with the particular article of clothing such as jersey 1. For example, by actually sewing or otherwise securing opposing boundary portions 36' of the pad 6 in FIGS. 16 and 17 to spaced-apart portions of the flexible jersey 1, the stretch or pull of the elastic jersey 1 at 51 during even normal breathing will enhance the contraction of the pad 6 (FIG. 16) and its overall pumping action (FIGS. 16–17). Such securing also helps to keep the particular pad firmly and properly in place in the jersey 1 or other article or articles of clothing (such as items 3, 5, 14, and 16 of FIG. 1, or similar ones).

Further, the securing of the pad such as 6 in FIGS. 16 and 17 to the jersey 1 integrates the jersey 1 into the pad 6 and in essence makes the jersey an extension of the pad casing 20. Consequently, during an impact 9 as in FIG. 18, the casing 20 reacts in the manner of FIG. 9 drawing in the casing sides 44 and 46 immediately adjacent the blow 9; and, because the inelastic casing 20 is secured at each side 36' to the jersey 1, the jersey 1 is also drawn in at 52. The jersey 1 about the athlete's chest 15 then acts with and under the influence of the casing 20 to further dissipate the force of the impact 9. The impact 9 in FIG. 18 is shown striking the far left pouch 50 for illustrative purposes. However, depending upon where the impact strikes across the pad 6 and how broad the impact is, the jersey 1 would be pulled or drawn in to different degrees from all directions or sides 36' about the pad 6. If the pad 6 is secured to the jersey 1 as in FIGS. 16–17, it can be done so directly without the need to form a pocket in the jersey 1 as in these FIGS. 16–17.

It is noted that FIGS. 16 and 17 schematically illustrate the pumping action of the pad 6 with arrows directed primarily away from and toward the athlete's chest 15. However, the pads of the present invention including pad 6 with pouches 50 in FIGS. 16 and 17 are extremely porous in all directions. Consequently, as schematically shown in FIG. 19, the air moving into and out of the pouch 50' of pad 6' (and every pad of the present invention) travels in all directions. In contrast, for example, sheets of closed-cell foam that are perforated in the fashion of swiss cheese may pass air through the holes but cannot pass air laterally through the foam sheet. To the extent the sheet is made of open-celled foam to pass air in all directions, it then has the distinct disadvantage of absorbing moisture and odor.

Figure 12:
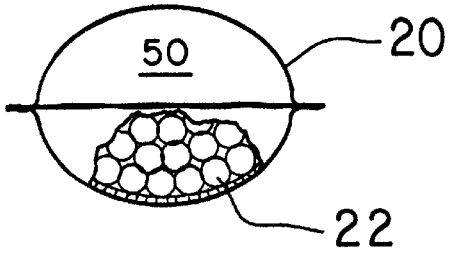
FIG. 12 illustrates a pad of the present invention with a single pouch that has a substantially circular cross section.

As discussed above, the prestressed or initially compressed condition of the elastic beads 22 in the free state of FIG. 12 tensions the inelastic, outer casing 20. In use, this also helps to prevent the beads 22 from moving relative to each other. The beads 22 in this regard essentially maintain or stay in their positions relative to each other and just vary their degree or amount of compression. Consequently, the overfilled pads of the present invention will not bottom out in use. This is an important feature of the pads, particularly as used in sports gear. Comfort of the pad against the athlete's body is also a concern. To the extent the casing 20 is made of relatively stiff material or material that tends to be abrasive or irritating to the athlete's skin, the jersey 1 in FIGS. 14 and 15 acts as a soft barrier to the casing 20. In other applications such as forearm or shin guards, an additional layer of soft material could be added if desired to the pads of the present invention between the casing 20 and the athlete's body.

The overfilling of the pads to compress the beads 22 and tension the outer casing 20 can be accomplished in a number of manners. The preferred and simplest method is to substantially, or completely, gravity fill the casing 20 as shown in solid lines in FIG. 20. The opposing sides 30 and 32 of the casing 20 can then be depressed or pinched to form the segment 34 (shown in dotted lines in FIG. 20). Thereafter, the segment 34 can be joined by heat sealing the sides 30 and 32 of the casing 20 together or by some other method such as sewing, stapling, or riveting. The segment 34 in this regard can extend partially across the pad as in FIGS. 4 and 6 or completely across the pad as in FIGS. 13–15 to make separate and distinct pouches 50. Single or unsegmented pads such as the pad in FIG. 12 can be made by simply cutting the segmented pad of FIG. 20 along the joined portion or seam 34 to form separate, individual pads. Other techniques to overfill the pads could also be used such as blowing, screwing, or ramming the beads under pressure into the pad to compress the beads and sealing the pad shut while the beads remain compressed. Multiple compression steps can also be performed as for example initially compressing the beads 22 by one of the above techniques and then further compressing them by adding more linear segments 34 or spot joining the opposing sides 30 and 32 of casing 20 with staples or rivets.

The padding technology of the present invention is equally adaptable for use under hard, outer shells such as those normally used in football shoulder pads and thigh pads. In adding an outer, hard shell 54 as illustrated in FIGS. 21 and 22, the shell 54 is preferably well perforated (see perforations 56 in FIG. 22) so as not to unduly reduce the breathability of the underlying pad 8. In use, the pad 8 with the outer, hard, porous shell 54 essentially operates as described above except that the initial impact force is immediately dissipated by the shell 54 and spread or applied to the pad 8 across a larger area than in the case of FIGS. 9–11. Lighter, less hard coverings or outer layers could also be used in place of the shell 54 if desired such as an additional mesh layer of relatively stiff material. The stiffness of the mesh of the casing 20 can also be varied as desired to be relatively soft or even approach the stiffness of a hard shell like 54. The stiffer the casing 20, the more it then acts like a hard shell 54 to spread out and dissipate the blow. When a hard shell 54 is used, it has been found desirable to use relatively soft beads 22 beneath the shell 54 so the overall padding does not become too hard. This is particularly advantageous in sports such as hockey in which nearly all the pads will have hard, outer shells 54. In such cases, the fact that air moves into and out of the pads in all directions (as schematically shown in FIG. 19) becomes very important as the hard shell 54, no matter how perforated or porous it is, tends to restrict air flow through it. However, with the pads of the present invention, the air movement then simply moves laterally or in all of the remaining directions not inhibited by the shell 54. In contrast as discussed above, closed-cell foam sheets perforated like swiss cheese will have any air flow blocked by the shell and air cannot move laterally through the sheet. If the foam is made of open-celled foam, air may flow around the shell but the foam will then absorb moisture and odors.

While several embodiments of the present invention have been shown and described in detail, it is to be understood that various changes and modifications could be made without departing from the scope of the invention. For example, as mentioned above and illustrated in FIG. 23, the beads could be of different sizes and shapes (e.g., spheres, cubes, oblongs, pyramids, and cylinders). In this regard, it has been found with beads of closed-cell polypropylene, for example, that it is preferred to use smaller diameter beads (e.g., 0.125 inches) packed fairly tightly (e.g., 140% overfill) for areas in which impact absorption is paramount (e.g., knee). Conversely, larger diameter beads (0.25 inches) of polypropylene with less compaction (e.g., 110%–120%) have been found to work better for areas in which breathability is of primary importance, such as in the chest area, to dissipate the athlete's body heat. Such larger diameter beads of polypropylene also tend to be softer than smaller diameter ones. Other factors such as the stiffness of the casing 20 as discussed above can also be varied as desired. In this manner, pads using the technology of the present invention can be custom designed not only for particular uses but also for particular individuals.

Further, and although the casing 20 is preferably overfilled only with compressible beads 22, portions of the fill could be other items with other properties (e.g., incompressible) as long as the fill was predominantly of the preferred, resilient, elastic members or beads 22 to give the pads the desirable characteristics discussed above. Additionally, the casing 20 has been discussed above as being preferably made of inelastic material. However, the casing 20 can be made of an elastic material if desired that was also flexible, porous, and breathable. The elastic casing 20 would then be preferably overfilled and expanded substantially to its elastic limit to place the beads 22 in compression and the stretched casing 20 in tension. The casing 20 would then act substantially in the manner of an inelastic one and the overall pad would perform substantially as discussed above and as illustrated in FIGS. 1–23. It is further noted that the padding of the present invention has been primarily disclosed as adapted for use in sports gear but it is equally adaptable for use wherever foam and other padding are used. For example, the padding technology of the present invention could be used as pads for fences, poles, trees, and walls as well as in industrial applications such as elevators and vehicle bumpers.

We claim:

1. A pad having a flexible, outer casing of porous, breathable, substantially inelastic material filled to over 100% of a gravity fill substantially with resilient, discrete beads of substantially elastic material.

2. The pad of claim 1 wherein substantially all of said beads are compressed within said casing.

3. The pad of claim 1 wherein said casing is a mesh.

4. The pad of claim 1 wherein said casing is made of heat sealable material.

5. The pad of claim 1 wherein at least one of said casing material and said bead material is substantially waterproof.

6. The pad of claim 1 wherein said casing material and said bead material are substantially waterproof.

7. The pad of claim 1 wherein said beads are made of closed-cell foam.

8. The pad of claim 1 wherein said beads are substantially spherical.

9. The pad of claim 1 wherein said spherical beads have diameters between about 0.05 and about 0.5 inches.

10. The pad of claim 1 wherein said beads are of different sizes.

11. The pad of claim 1 wherein said beads are of different shapes.

12. The pad of claim 1 wherein said overfill is over 100% and up to about 160% of a gravity fill.

13. The pad of claim 12 wherein said overfill is about 120% of a gravity fill.

14. The pad of claim 1 wherein each of said beads has a relaxed volume and substantially all of said beads are compressed within said casing to less than 100% of the respective relaxed volume.

15. The pad of claim 14 wherein substantially all of said beads are compressed between about 40% and under 100% of the respective relaxed volume.

16. The pad of claim 15 wherein substantially all of said beads are compressed to about 80% of the respective relaxed volume.

17. The pad of claim 1 wherein portions of adjacent beads abut one another and other portions of said adjacent beads are spaced from each other to create interstitial spaces.

18. The pad of claim 17 wherein the casing and interstitial spaces have respective volumes and the volume of said interstitial spaces is about 35% to about 15% of said casing volume.

19. The pad of claim 18 wherein the volume of said interstitial spaces is about 25% to about 30% of said casing volume.

20. The pad of claim 1 including means for biasing said flexible casing toward a first shape.

21. The pad of claim 1 wherein substantially all of said beads are compressed within said casing and said casing is tensioned by said beads.

22. The pad of claim 1 wherein substantially all of said beads are compressed within said casing and wherein said flexible casing can assume at least first and second, different shapes and volumes with the volume within the casing being greater in said first shape than in said second shape whereby substantially all of said beads are further compressed by said casing in said second shape.

23. The pad of claim 22 wherein said pad includes means for pumping air into and out of said pad through said porous casing as said casing moves between said first and second shapes.

24. The pad of claim 23 wherein said pumping means further includes an article of clothing.

25. The pad of claim 24 wherein said pumping means includes means for securing said pad to said article of clothing for movement therewith.

26. The pad of claim 24 wherein said pad has spaced-apart portions and said pumping means includes means for securing said spaced-apart portions to said article of clothing for movement therewith.

27. The pad of claim 22 wherein portions of adjacent beads abut one another and other portions of said adjacent beads are spaced from each other to create interstitial spaces and wherein the total volumes of the interstitial spaces of said first and second shapes are different to thereby create a pumping effect of air into and out of the pad through said porous casing and interstitial spaces.

28. The pad of claim 22 including means for biasing said casing toward said first shape.

29. The pad of claim 1 wherein said casing has a boundary and opposing portions within said boundary and wherein said pad further includes means for joining said opposing portions together within said boundary.

30. The pad of claim 29 wherein said joining means joins said opposing portions substantially linearly.

31. The pad of claim 29 wherein said joining means joins said opposing portions substantially at a spot.

32. The pad of claim 29 wherein said joining means forms at least one predetermined flex pattern within the boundary of said casing.

33. The pad of claim 29 wherein said joining means forms at least two, predetermined flex patterns along substantially perpendicular lines within the boundary of said casing.

34. The pad of claim 1 wherein said beads assume first positions relative to each other and said pad can assume at least first and second, different shapes and wherein said pad includes means for substantially maintaining said beads in said first relative positions in said first and second shapes.

35. The pad of claim 34 wherein adjacent beads within said casing abut one another.

36. The pad of claim 1 wherein said pad further includes an outer, hard shell.

37. The pad of claim 36 wherein said outer, hard shell is substantially porous.

38. The pad of claim 1 wherein said flexible casing can assume at least first and second, different shapes and said pad further includes an article of clothing and means for securing said pad to said article of clothing for movement with each other as said flexible casing moves between said first and second shapes.

39. The pad of claim 38 wherein said pad and said article of clothing have respective spaced-apart portions respectively secured to each other for movement with each other.

40. A pad having a flexible, outer casing of porous, breathable material overfilled substantially with resilient, discrete beads of elastic material wherein said flexible casing can assume at least first and second, different shapes with at least some of said beads being compressed to different amounts in said second shape than in said first shape, and means for moving said casing substantially between said first and second shapes to pump air into and out of said pad through said porous casing as said casing is moved between said first and second shapes.

41. The pad of claim 40 wherein said moving means includes an article of clothing.

42. The pad of claim 41 wherein said moving means includes means for securing said pad to said article of clothing for movement therewith.

43. The pad of claim 41 wherein said pad has spaced-apart portions and said moving means includes means for securing said spaced-apart portions to said article of clothing for movement therewith.

44. The pad of claim 43 wherein said pad has a boundary and said spaced-apart portions are portions of said boundary.

45. The pad of claim 43 wherein said article of clothing is made of stretchable, elastic material and has spaced-apart portions and said securing means respectively secures one of said pad portions to one of the portions of said article and the other of said pad portions to the other of said portions of said article wherein movement of the spaced-apart portions of said article relative to each other causes said spaced-apart portions of said pad to move relative to each other and said pad to move between said first and second shapes.

46. The pad of claim 40 wherein portions of adjacent beads abut one another and other portions of said adjacent beads are spaced from each other to create interstitial spaces and wherein the total volumes of the interstitial spaces of said first and second shapes are different to thereby create a pumping effect of air into and out of the pad through said porous casing and interstitial spaces.

* * * * *